US011629575B2

(12) United States Patent
Al Khalifah et al.

(10) Patent No.: US 11,629,575 B2
(45) Date of Patent: Apr. 18, 2023

(54) CONTROLLING FLUID FLOW THROUGH A DOWNHOLE TOOL

(71) Applicant: Saudi Arabian Oil Company, Dhahran (SA)

(72) Inventors: Jawad Al Khalifah, Jeddah (SA); Alaa Shawly, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 152 days.

(21) Appl. No.: 17/166,197

(22) Filed: Feb. 3, 2021

(65) Prior Publication Data

US 2022/0243558 A1 Aug. 4, 2022

(51) Int. Cl.

| | |
|---|---|
| ***E21B 34/14*** | (2006.01) |
| ***E21B 43/12*** | (2006.01) |
| ***E21B 43/14*** | (2006.01) |
| *E21B 47/18* | (2012.01) |

(52) U.S. Cl.

CPC ..... *E21B 34/142* (2020.05); *E21B 43/126* (2013.01); *E21B 43/128* (2013.01); *E21B 43/14* (2013.01); *E21B 47/18* (2013.01); *E21B 2200/04* (2020.05)

(58) Field of Classification Search

CPC ..... E21B 47/18; E21B 23/10; E21B 23/12; E21B 17/18

See application file for complete search history.

(56) References Cited

U.S. PATENT DOCUMENTS

| | | | | |
|---|---|---|---|---|
| 6,199,633 | B1 * | 3/2001 | Longbottom | E21B 7/04 166/242.6 |
| 10,167,708 | B2 | 1/2019 | Beveridge | |
| 2003/0015323 | A1 | 1/2003 | Norris | |
| 2005/0103497 | A1 * | 5/2005 | Gondouin | E21B 43/121 166/57 |
| 2006/0196660 | A1 * | 9/2006 | Patel | E21B 43/12 166/250.15 |
| 2009/0200034 | A1 * | 8/2009 | Leitch | E21B 43/128 166/321 |
| 2013/0277064 | A1 * | 10/2013 | Xiao | E21B 43/129 166/372 |
| 2015/0041126 | A1 * | 2/2015 | Boyle | E21B 43/2406 166/57 |
| 2015/0345264 | A1 * | 12/2015 | Johnson | E21B 43/12 166/105.1 |

(Continued)

*Primary Examiner* — David Carroll
(74) *Attorney, Agent, or Firm* — Fish & Richardson P.C.

(57) ABSTRACT

A downhole tool includes a y-tubular section sized to run into a wellbore and configured to couple to a production tubing. The y-tubular section includes a main tubular section, a primary tubular leg coupled to the main tubular section, and a secondary tubular leg coupled to the main tubular section and offset from the primary tubular leg. The secondary tubular leg is sized to receive an electrical submersible pump (ESP). A hydraulic flow control device is positioned in the primary tubular leg and configured to selectively modulate toward an open position to fluidly couple the main tubular section to a portion of the primary tubular leg and selectively modulate toward a closed position to fluidly decouple the secondary tubular leg from a portion of the primary tubular leg based on a hydraulic signal from a hydraulic fluid system positioned at or near a terranean surface.

21 Claims, 5 Drawing Sheets

(56) References Cited

U.S. PATENT DOCUMENTS

| | | | | |
|---|---|---|---|---|
| 2017/0030172 | A1 | 2/2017 | Fielder, III et al. | |
| 2019/0145220 | A1* | 5/2019 | Patel | E21B 34/10 166/375 |
| 2019/0368291 | A1* | 12/2019 | Xiao | E21B 43/128 |
| 2020/0141211 | A1* | 5/2020 | Franklin | E21B 43/10 |
| 2020/0157898 | A1* | 5/2020 | Leismer | E21B 23/03 |

* cited by examiner

CONTROLLING FLUID FLOW THROUGH A DOWNHOLE TOOL

TECHNICAL FIELD

The present disclosure describes apparatus, systems, and methods for controlling fluid flow through a downhole tool and, more particularly, controlling fluid flow through a downhole y-tool in combination with a downhole pump.

BACKGROUND

An electrical submersible pump (ESP) is one of many types of pumps that can be used in a well to circulate hydrocarbon fluids to the surface. In some cases, an ESP is used with an associated bypass system. The bypass system permits access to the well downhole of the ESP so that, for example, logging operations and other intervention work may be performed in the well without removal of the ESP. A bypass branch depends from one branch of a forked tubing and a second branch includes the ESP. Both branches communicate with the production tubing of the well. The bypass branch is sealed during production of fluid from the well by installing a blanking plug or a device that relies on differential pressure to prevent recirculation of the fluid from the ESP discharge via the bypass branch back to the well.

SUMMARY

In an example implementation, a downhole tool includes a y-tubular section sized to run into a wellbore formed from a terranean surface into a subterranean zone and configured to couple to a production tubing. The y-tubular section includes a main tubular section, a primary tubular leg coupled to the main tubular section, and a secondary tubular leg coupled to the main tubular section and offset from the primary tubular leg. The secondary tubular leg is sized to receive an electrical submersible pump (ESP). The downhole tool further includes a hydraulic flow control device positioned in the primary tubular leg and configured to selectively modulate toward an open position to fluidly couple the main tubular section to a portion of the primary tubular leg downhole of the flow control device and selectively modulate toward a closed position to fluidly decouple the secondary tubular leg from a portion of the primary tubular leg downhole of the flow control device based on a hydraulic signal from a hydraulic fluid system positioned at or near a terranean surface.

In an aspect combinable with the example implementation, the hydraulic flow control device includes a ball valve that includes a housing including a housing bore; and a ball at least partially enclosed within the housing and including a ball bore alignable with the housing bore based on selective modulation of the flow control device toward the open position to fluidly couple the main tubular section to the portion of the primary tubular leg and misalignable with the housing bore based on selective modulation of the flow control device toward the closed position to fluidly decouple the secondary tubular leg from the portion of the primary tubular leg.

In another aspect combinable with any one of the previous aspects, the ball bore is sized to receive a logging tool therethrough.

In another aspect combinable with any one of the previous aspects, the ball valve includes a hydraulic fluid chamber including a volume sized to enclose a portion of hydraulic fluid from the hydraulic fluid system.

In another aspect combinable with any one of the previous aspects, the hydraulic signal includes a change of pressure of the hydraulic fluid in the hydraulic fluid chamber based on operation of the hydraulic fluid system.

In another aspect combinable with any one of the previous aspects, the hydraulic fluid system includes a hydraulic fluid pump and a hydraulic fluid controller.

In another aspect combinable with any one of the previous aspects, the hydraulic signal from the hydraulic fluid system positioned at or near the terranean surface is independent of a differential pressure across the hydraulic flow control device.

In another aspect combinable with any one of the previous aspects, the hydraulic flow control device is communicably coupled to the ESP.

In another example implementation, a method includes identifying a downhole tool coupled to a production tubing that is positioned in a wellbore formed from a terranean surface and extended into a subterranean formation. The downhole tool includes a y-tubular section that includes a main tubular section, a primary tubular leg coupled to the main tubular section, and a secondary tubular leg coupled to the main tubular section and offset from the primary tubular leg, and a hydraulic flow control device positioned in the primary tubular leg. The method further includes modulating the flow control device toward a closed position to fluidly decouple the secondary tubular leg from a portion of the primary tubular leg downhole of the hydraulic flow control device based on a hydraulic signal from a hydraulic fluid system positioned at or near the terranean surface; subsequent to modulating the flow control device to the closed position, operating an electrical submersible pump (ESP) that is at least partially positioned in the secondary tubular leg to circulate a wellbore fluid through the secondary tubular leg, through the main tubular section, and into the production tubing; modulating the flow control device toward an open position to fluidly couple the main tubular section to a portion of the primary tubular leg downhole of the flow control device based on another hydraulic signal from the hydraulic fluid system; and prior to or subsequent to modulating the flow control device to the open position, stopping operation of the ESP.

An aspect combinable with the example implementation further includes, subsequent to modulating the flow control device to the open position, running a logging tool through the flow control device to log a portion of the wellbore downhole of the y-tubular section.

Another aspect combinable with any one of the previous aspects further includes running the downhole tool into the wellbore.

In another aspect combinable with any one of the previous aspects, the flow control device includes a ball valve that includes a housing including a housing bore, and a ball at least partially enclosed within the housing and including a ball bore.

Another aspect combinable with any one of the previous aspects further includes aligning the ball bore with the housing bore based on modulating the flow control device toward the open position to fluidly couple the main tubular section to the portion of the primary tubular leg; and misaligning the ball bore with the housing bore based on modulating the flow control device toward a closed position to fluidly decouple the secondary tubular leg from the portion of the primary tubular leg.

In another aspect combinable with any one of the previous aspects, the ball valve includes a hydraulic fluid chamber including a volume.

Another aspect combinable with any one of the previous aspects further includes circulating a portion of hydraulic fluid from the hydraulic fluid system into the volume.

In another aspect combinable with any one of the previous aspects, the hydraulic signal includes a change of pressure of the hydraulic fluid in the hydraulic fluid chamber based on operation of the hydraulic fluid system.

Another aspect combinable with any one of the previous aspects further includes providing the hydraulic signal by operating a hydraulic fluid pump with a hydraulic fluid controller of the hydraulic fluid system.

In another aspect combinable with any one of the previous aspects, providing the hydraulic signal includes providing the hydraulic signal independent of a differential pressure across the flow control device.

In another aspect combinable with any one of the previous aspects, the flow control device is communicably coupled to the ESP.

In another example implementation, a downhole flow control system includes a production tubing positioned within a wellbore that extends from a terranean surface into a subterranean formation; a y-tool; a downhole pump; and a control system. The y-tool includes a main tubular section coupled to the production tubing, a primary tubular leg coupled to the main tubular section, and a secondary tubular leg coupled to the main tubular section and offset from the primary tubular leg, and a hydraulic ball valve positioned in the primary tubular leg. The downhole pump is positioned in or downhole of the secondary tubular leg. The control system is positioned at or near the terranean surface and configured to perform operations including transmitting a hydraulic signal to the hydraulic ball valve to modulate to a closed position; when the hydraulic ball valve is in the closed position, operating the downhole pump to circulate a wellbore fluid through the secondary tubular leg and into the production tubing through the main tubular section; transmitting another hydraulic signal to the hydraulic ball valve to modulate to an open position; and when the hydraulic ball valve is in the open position, stopping operation of the downhole pump.

In an aspect combinable with the example implementation, the control system includes a hydraulic fluid pump and a hydraulic fluid pump controller.

In another aspect combinable with any one of the previous aspects, the operation of transmitting the hydraulic signal to the hydraulic ball valve includes operating, with the hydraulic fluid pump controller, the hydraulic fluid pump to circulate a hydraulic fluid at a particular pressure to the hydraulic ball valve.

In another aspect combinable with any one of the previous aspects, the operation of transmitting the another hydraulic signal to the hydraulic ball valve includes operating, with the hydraulic fluid pump controller, the hydraulic fluid pump to circulate the hydraulic fluid at another particular pressure to the hydraulic ball valve.

In another aspect combinable with any one of the previous aspects, the downhole pump includes an electrical submersible pump (ESP).

Implementations of a flow control system including a downhole tool according to the present disclosure may include one or more of the following features. For example, a flow control system including a downhole tool according to the present disclosure can prevent recirculation of produced fluid when a downhole pump is operating and open it to permit intervention work within a wellbore below the pump. As another example, a flow control system including a downhole tool excludes a need for periodic installation and removal of a plug in a y-tool, which is time consuming and adds to an overall cost of operation. As another example, a flow control system including a downhole tool can operate exclusive of a differential pressure across a flow control device of the downhole tool, which can be an unreliable technique for operating the flow control device in a y-tool.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
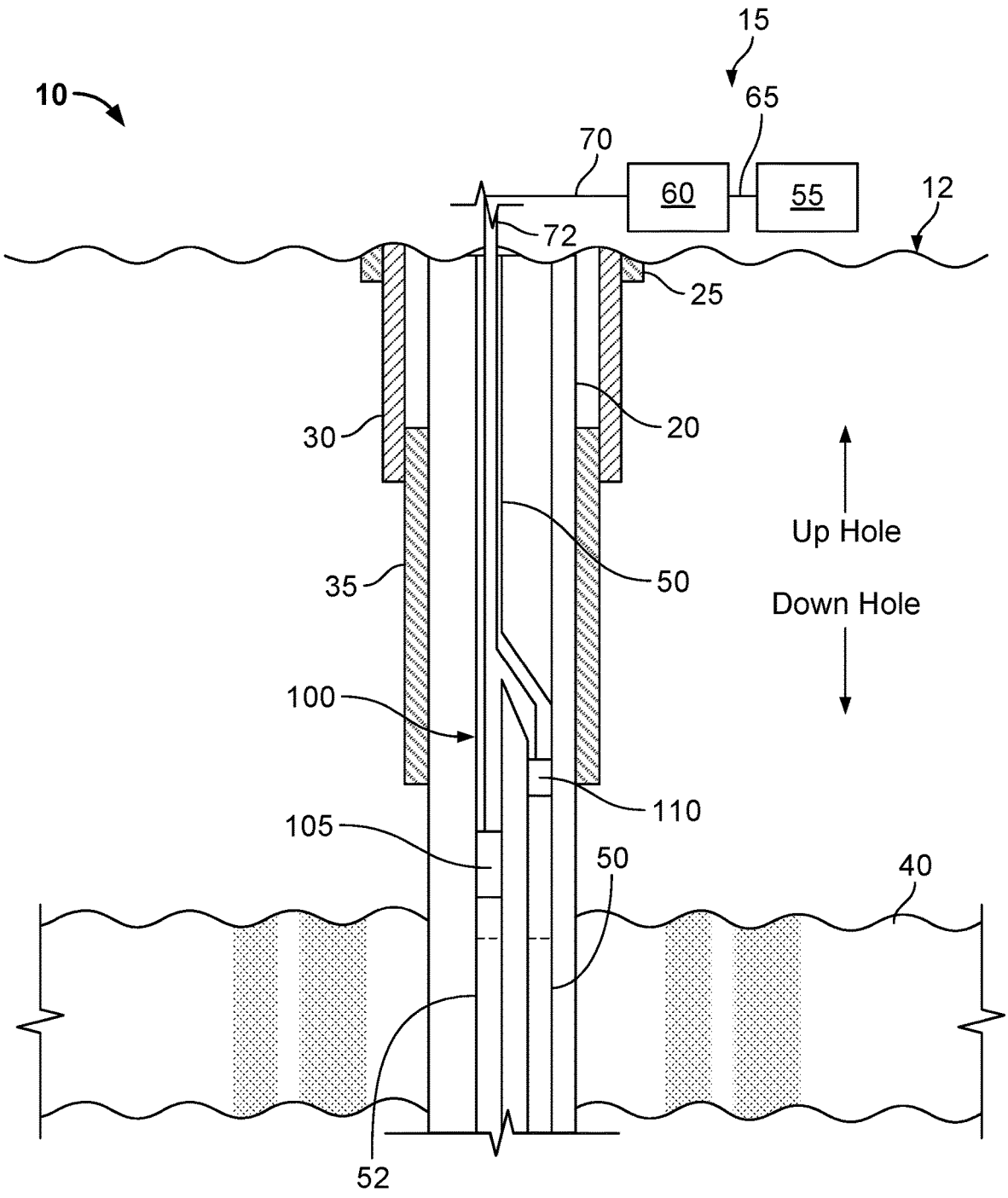
FIG. 1 is a schematic diagram of an example implementation of a downhole flow control system including a downhole tool according to the present disclosure.

FIG. 1 is a schematic diagram of an example implementation of a downhole flow control system 10 including a downhole tool 100. Generally, FIG. 1 illustrates at least a portion of one implementation of the downhole flow control system 10 according to the present disclosure in which the downhole tool 100 may be run into a wellbore 20 on a wellbore tubular 50 (for example, a production tubular 50) within the wellbore 20. In this example, an uphole end of the downhole tool 100 is coupled to the wellbore tubular 50 while a portion of a downhole end of the downhole tool 100 is coupled to the wellbore tubular 50 and another portion of the downhole end of the downhole tool is coupled to a logging tubular 52 (or can be open to the wellbore 20 at the downhole end of the downhole tool 100. Thus, in this example, the downhole tool 100 comprises a y-tool that includes a main tubular section, a primary tubular leg, and a secondary tubular leg (as described in more detail with reference to FIG. 2).

As shown, the downhole flow control system 10 accesses a subterranean formation 40 and provides access to hydrocarbons located in such subterranean formation 40. In an example implementation of system 10, the system 10 may be used for a production operation in which the hydrocarbons may be produced from the subterranean formation 40 through the downhole tool 100 and to the wellbore tubular 50 (for example, as a production tubing or casing) uphole of the downhole tool 100 by a downhole pump 110 (for example, an electrical submersible pump (ESP) 110) coupled to a pump controller through downhole conveyance 72 (for example, a wireline or other conveyance operable to control the pump 110). However, tubular 50 may represent any tubular member positioned in the wellbore 20 such as, for example, coiled tubing, any type of casing, a liner or lining, another downhole tool connected to a work string (in other words, multiple tubulars threaded together), or other form of tubular member.

A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20. In some implementations, a drilling assembly used to form the wellbore 20 may be deployed on a body of water rather than the terranean surface 12. For instance, in some implementations, the terranean surface 12 may be an ocean, gulf, sea, or any other body of water under which hydrocarbon-bearing formations may be found. In short, reference to the terranean surface 12 includes both land and water surfaces and contemplates forming and developing one or more downhole flow control systems10 from either or both locations.

In some implementations of the downhole flow control system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some implementations, the wellbore 20 may be offset from vertical (for example, a slant wellbore). Even further, in some implementations, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35. Any of the illustrated casings, as well as other casings that may be present in the downhole flow control system 10, may include one or more casing collars.

In this example implementation of the flow control system 10, the downhole tool 100 includes a flow control device 105, such as a hydraulic flow control device that is fluidly coupled to a hydraulic flow control system 15 positioned at or near the terranean surface 12 through a hydraulic fluid line 70. The hydraulic flow control system 15 includes, in this example, a hydraulic pump 55 and hydraulic fluid control panel 60 that controls circulation (and pressure) of a hydraulic fluid 65 pumped through the hydraulic fluid control panel 60 into the hydraulic fluid line 70 to the flow control device 105. As explained in more detail below, a pressure, flow rate, or both of the hydraulic fluid 65 in the hydraulic fluid line 70 is controlled and provided to the flow control device 105 to actuate (for example, modulate toward and to a closed position, modulate toward or to an open position, or both) the flow control device 105 to fluidly decouple or fluidly decouple one portion of the downhole tool 100 and another portion of the downhole tool 100.

Figure 2:
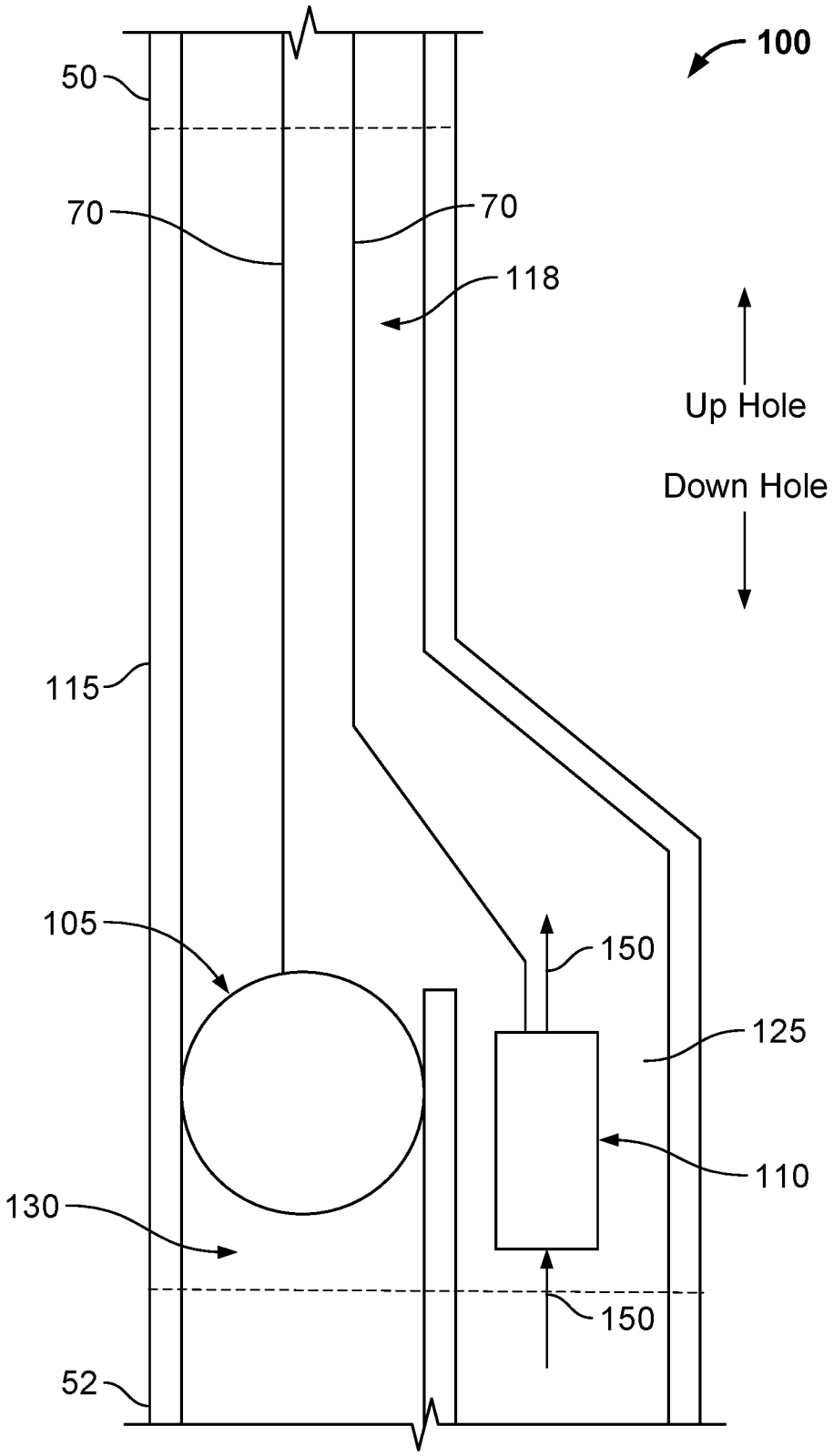
FIG. 2 is a schematic diagram of an example implementation of a downhole tool according to the present disclosure.

FIG. 2 is a schematic diagram of an example implementation of the downhole tool 100 according to the present disclosure. As shown in FIG. 2, the downhole tool 100 includes a housing 115 that couples (for example, threadingly or otherwise) at an uphole end to the wellbore tubular 50. The housing 115, in this example, is a y-housing (also called a y-tool) that includes a main tubular portion 118 (that couples to the wellbore tubular 50), a primary tubular leg 130 aligned with the main tubular portion 118, and a secondary tubular leg 125 offset (as in the shape of a "y") from the primary tubular leg 130. As shown in this example, the primary tubular leg 130 is coupled to another section of the wellbore tubular 50 (for example, a logging tubular), but alternatively, may be left open to the wellbore. The secondary tubular leg 125, in this example, is also coupled (downhole of the tool 100) to another portion of the wellbore tubular 50.

In this example implementation, the downhole pump, or ESP 110, is positioned in the secondary tubular leg 125 and connected (for example, communicably) to the downhole conveyance, or wireline 72. Although not shown here, a wireline 72 or other communication conductor may communicably connect the ESP 110 to the flow control device 105, which is positioned in the primary tubular leg 130. As shown here, the hydraulic fluid line 70 fluidly coupled the flow control device 105 (as a hydraulically controlled device) to the hydraulic flow control system 15.

As shown in FIG. 2, the secondary tubular leg 125 is fluidly coupled and open to the main tubular section 118, for example, uphole of the flow control device 105. Thus, a wellbore fluid 150 can be circulated by the ESP 110, through the secondary tubular leg 125, into the main tubular section 118 and into the wellbore tubular 50 (for example, production tubing 50). The secondary tubular leg 125 (and the main tubular section 118) is fluidly decoupled from a portion of the primary tubular leg 130 that is downhole of the flow control device 105 when the device 105 is in a closed position. In some aspects, during operation of the ESP 110, the flow control device 105 is in the closed position to direct all wellbore fluids 150 from the secondary tubular leg 125 to the main tubular section 118.

The secondary tubular leg 125 (and the main tubular section 118) is fluidly coupled to the portion of the primary tubular leg 130 that is downhole of the flow control device 105 when the device 105 is in an open position. In some aspects, during non-operation of the ESP 110, such as when a logging tool or other secondary operation is desired downhole of the downhole tool 100, the flow control device 105 is in open position to allow such a tool to be run into the wellbore 20, through the open flow control device 105, and into the wellbore 20 (whether through another tubular or not). Operation of the flow control device 105, such as modulating the device 105 to or toward the closed position or modulating the device 105 to or toward the open position, can be initiated by a hydraulic fluid signal (for example, hydraulic fluid at a particular pressure, or pressure differential, or flow rate) from the hydraulic fluid line 70 to the control device 105.

Figure 3:
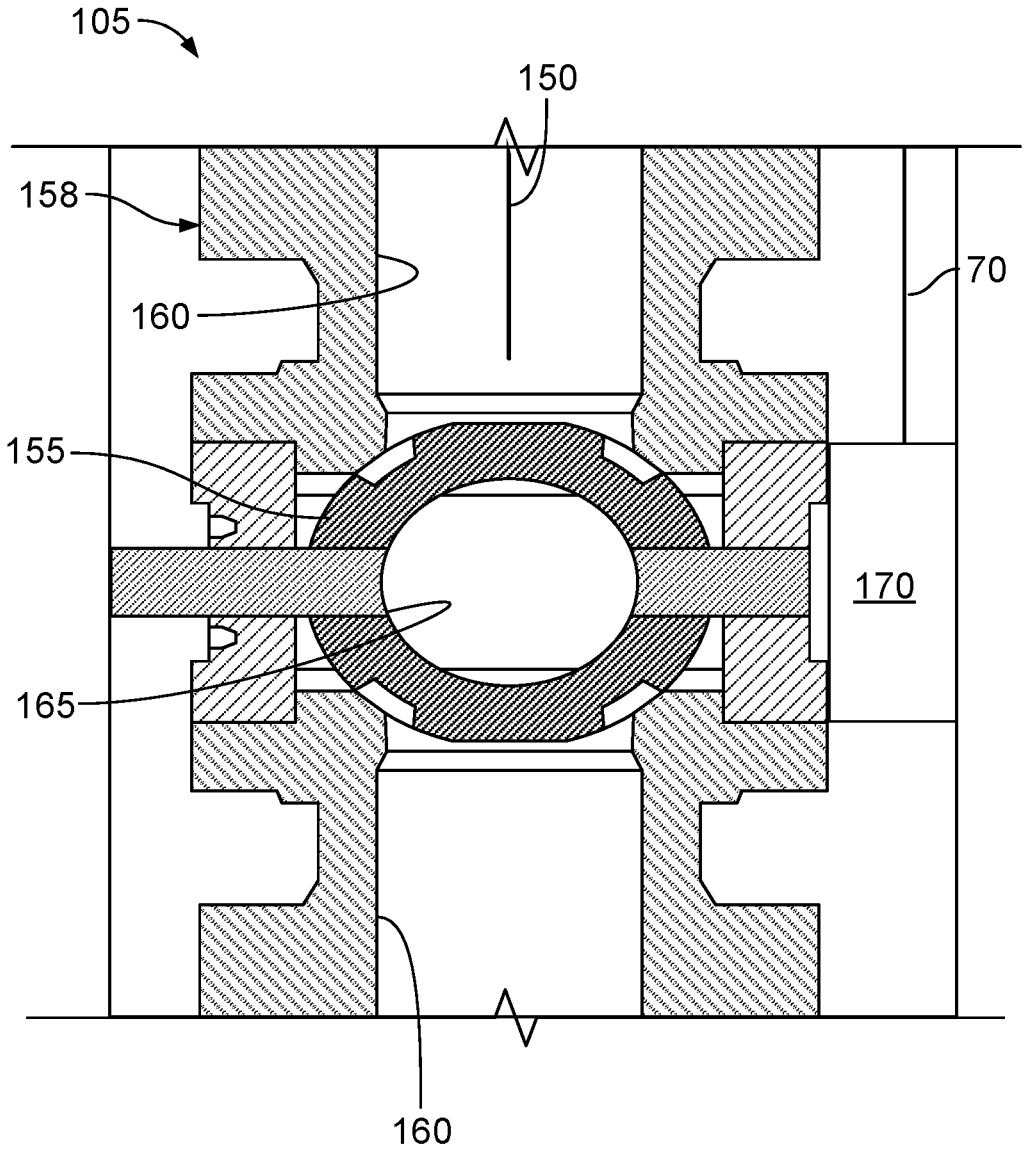
FIG. 3 is a schematic diagram of an example implementation of a flow control device of a downhole tool according to the present disclosure.

FIG. 3 is a schematic diagram of an example implementation of the flow control device 105 of the downhole tool 100 according to the present disclosure. In this example implementation, the flow control device 105 is a hydraulically-controlled ball valve 105. Alternatively, the flow control device 105 may be a hydraulically-(or electrically-) controlled device such as a plug valve, slam valve, or other modulating or shut-off valve or restriction. As shown in FIG. 3, the ball valve 105 includes a housing 158 through which a housing bore 160 is formed. A ball 155 is positioned in the housing 158 and moveable so as to align a ball bore 165 with the housing bore 160 (to open the ball valve 105) or misalign the ball bore 165 with the housing bore 160 (to close the ball valve 105). In this illustration, the ball bore 165 is misaligned with the housing bore 160, thereby illustrating the ball valve 105 in the closed position to prevent wellbore fluid 150 from circulating through the ball valve 105.

In this example implementation, the ball valve 105 includes a hydraulic fluid reservoir 170 that encloses or holds a portion of hydraulic fluid circulated through the hydraulic fluid line 70 from the hydraulic flow control system 15 to control operation of the ball valve 105. The hydraulic fluid stored in the hydraulic fluid reservoir 170, for example, based on a change of pressure, can operate the ball valve 105 to the closed position (for example, at a first particular pressure as set by the hydraulic fluid control panel 60) or the open position (for example, at a second particular pressure as set by the hydraulic fluid control panel 60).

Figure 4:
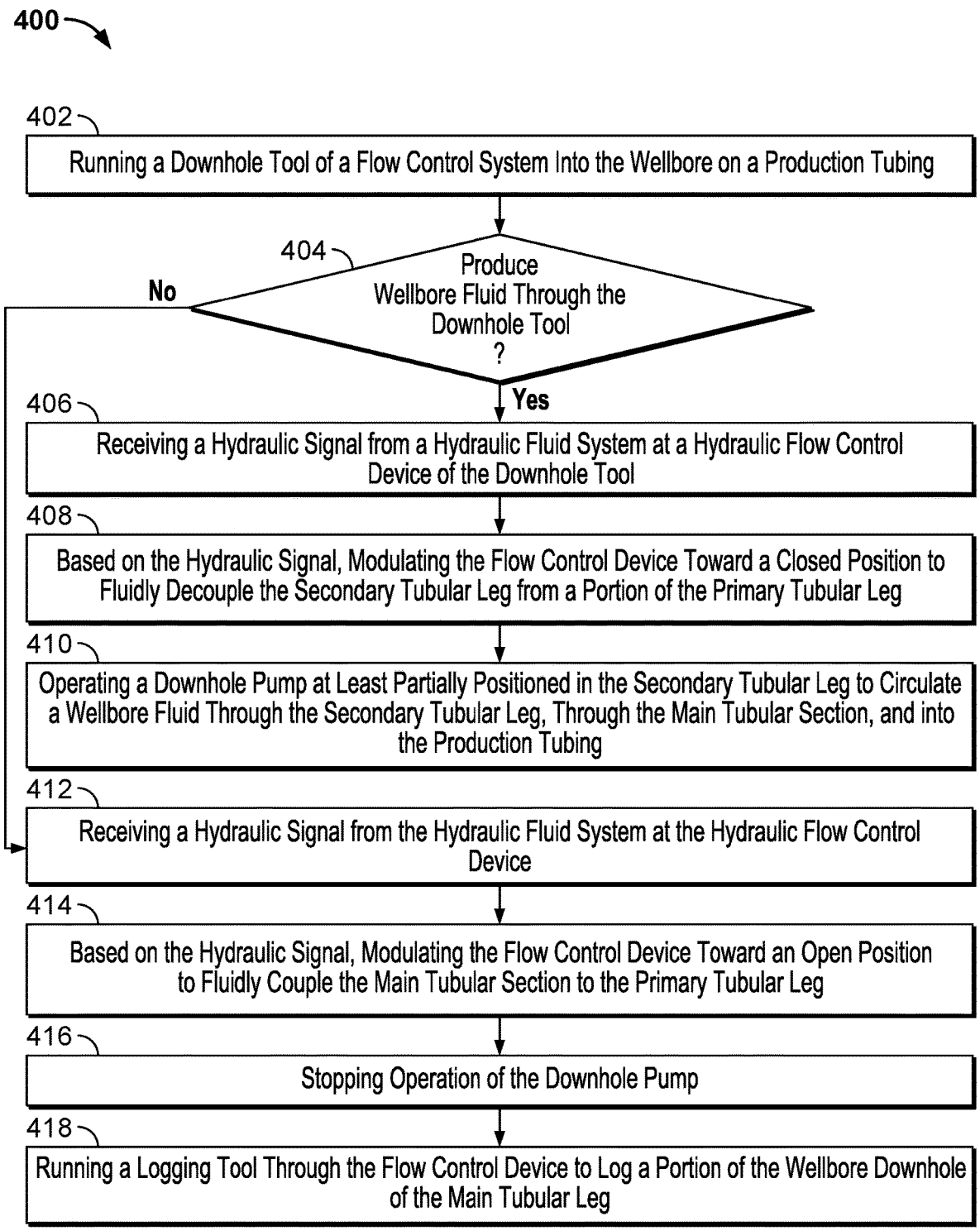
FIG. 4 is a flowchart of an example method performed with or by an example implementation of a downhole flow control system including a downhole tool according to the present disclosure.

FIG. 4 is a flowchart of an example method 400 performed with or by an example implementation of a downhole flow control system including a downhole tool according to the present disclosure. For instance, method 400 may be performed with or by the downhole flow control system 10 and downhole tool 100 shown in FIGS. 1, 2, and 3.

Method 400 can begin at step 402, which includes running a downhole tool of a flow control system into the wellbore on a production tubing. For example, the downhole tool 100 can be coupled (for example, threadingly or otherwise) to the wellbore tubular 50 (as a production tubing) and moved into the wellbore 20. The downhole tool 100 can be positioned in the wellbore 20 at a location from which wellbore fluid 150 can be produced by the ESP 110, through the secondary tubular leg 125, into the main tubular section 118, and to the terranean surface 12.

Method 400 can continue at step 404, which includes a decision to produce wellbore fluid□through the downhole tool or not. For example, if wellbore fluid 150, which includes one or more hydrocarbons, is to be produced, then the decision in step 404 is yes. If the wellbore fluid 150 is not to be produced, then the decision in step 404 is no.

If the decision in step 404 is yes, then method 400 can continue at step 406, which includes receiving a hydraulic signal from a hydraulic fluid system at a hydraulic flow control device of the downhole tool. For example, the hydraulic flow control system 15 can provide the hydraulic signal in the form of a hydraulic fluid, for example, at a particular pressure or pressure differential, at the flow control device 105.

Method 400 can continue at step 408, which includes, based on the hydraulic signal, modulating the flow control device toward a closed position to fluidly decouple the secondary tubular leg from a portion of the primary tubular leg. For example, when the flow control device 105, such as the ball valve 105, receives the hydraulic signal, the ball valve 105 is adjusted to or toward the closed position. In the closed position, the ball valve 105 fluidly decouples the primary tubular leg 130 from the secondary tubular leg 125. Decoupled, any wellbore fluid 150 circulated by the ESP 110 moves from the secondary tubular leg 125 into the main tubular section 118 rather than the primary tubular leg 130.

Method 400 can continue at step 410, which includes operating a downhole pump at least partially positioned in the secondary tubular leg to circulate a wellbore fluid through the secondary tubular leg, through the main tubular section, and into the production tubing. For example, when the ESP 110 is operated, wellbore fluid 150 is circulated from the wellbore 20 downhole of the secondary tubular leg 125, which, in some aspects, is always fully open, to the main tubular section 118 and into the wellbore tubular 50 (and to the terranean surface).

If the decision in step 404 is no, then method 400 can continue at step 412, which includes receiving another hydraulic signal from the hydraulic fluid system at the hydraulic flow control device. For example, the hydraulic flow control system 15 can provide another hydraulic signal in the form of the hydraulic fluid, for example, at another particular pressure or pressure differential (for example, different than the pressure or differential pressure of step 406), at the flow control device 105.

Method 400 can continue at step 414, which includes, based on the another hydraulic signal, modulating the flow control device toward an open position to fluidly couple the main tubular section to the primary tubular leg. For example, when the flow control device 105, such as the ball valve 105, receives the another hydraulic signal, the ball valve 105 is adjusted to or toward the open position. In the open position, the ball valve 105 fluidly couples the primary tubular leg 130 with the main tubular section 118 (and the secondary tubular leg 125).

Method 400 can continue at step 416, which includes stopping operation of the downhole pump. For example, once the primary and secondary tubular legs 130 and 125, respectively, are fluidly coupled (or before step 414), the ESP 110 is turned off to cease circulation of the wellbore fluid 150 into the main tubular section 118.

Method 400 can continue at step 418, which includes running a logging tool through the flow control device to log a portion of the wellbore downhole of the main tubular leg. For example, the flow control device 105 (for example the ball bore 165) may be sized to receive a logging tool (or other secondary production tool) there through. The logging tool can be run through the flow control device 105 and into the wellbore 20 downhole of the downhole tool 100 in order to, for example, measure one or more properties of the a subterranean formation.

Figure 5:
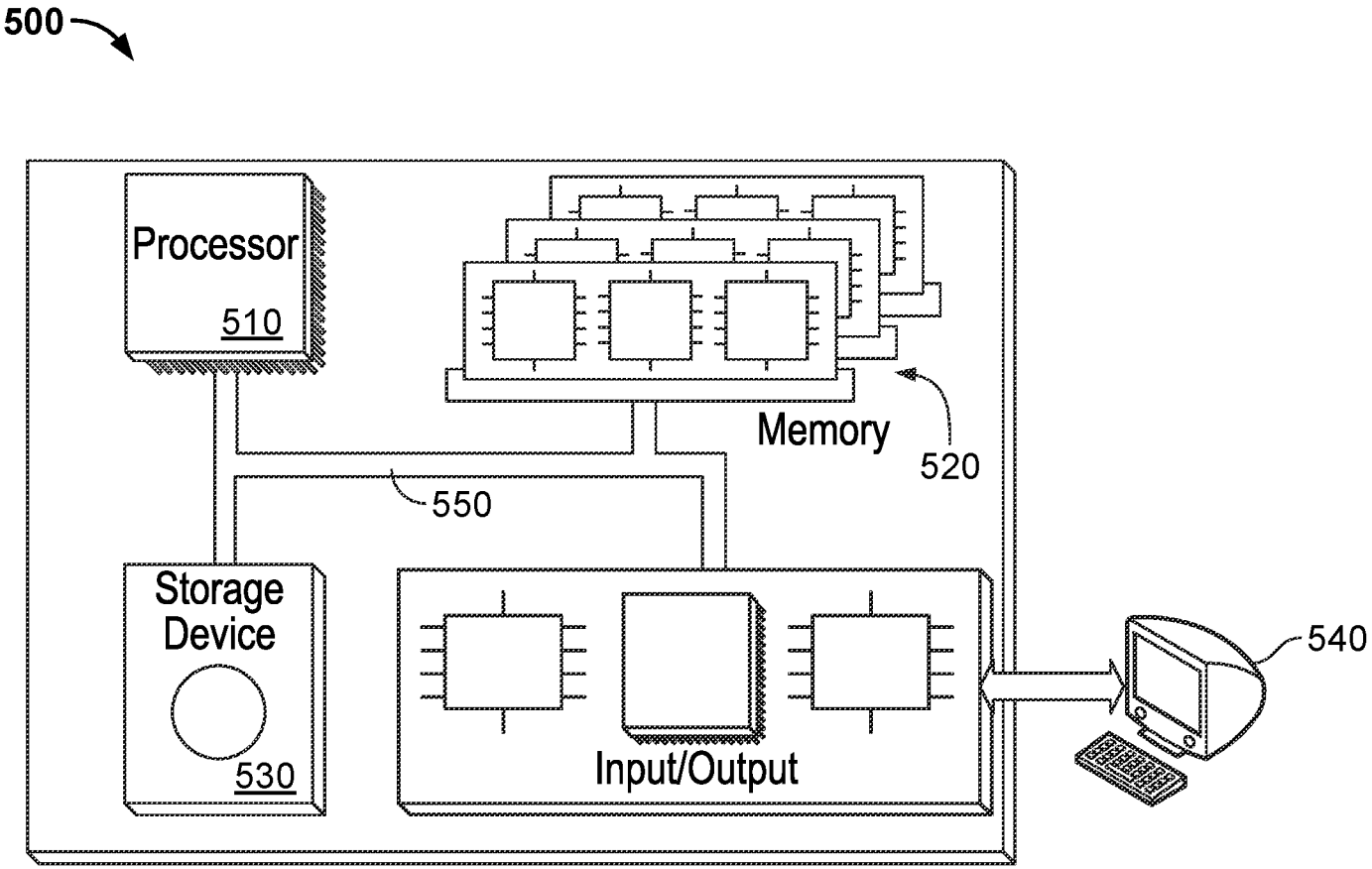
FIG. 5 is a schematic illustration of an example controller (or control system) for operating a downhole flow control system according to the present disclosure.

FIG. 5 is a schematic illustration of an example controller 500 (or control system) for operating a downhole flow control system, such as all or a portion of flow control system 10 of FIG. 1. For example, all or parts of the controller 500 can be used for the operations described previously, for example as or as part of the hydraulic flow control system 15, including the hydraulic pump 55 and hydraulic fluid control panel 60. For example, the controller 500 may comprise all or a part of the hydraulic fluid control panel 60 (as well as another controller for the downhole pump 110). The controller 500 is intended to include various forms of digital computers, such as printed circuit boards (PCB), processors, digital circuitry, or otherwise. Additionally the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 500 includes a processor 510, a memory 520, a storage device 530, and an input/output device 540. Each of the components 510, 520, 530, and 540 are interconnected using a system bus 550. The processor 510 is capable of processing instructions for execution within the controller 500. The processor may be designed using any of a number of architectures. For example, the processor 510 may be a CISC (Complex Instruction Set Computers) processor, a RISC (Reduced Instruction Set Computer) processor, or a MISC (Minimal Instruction Set Computer) processor.

In one implementation, the processor 510 is a single-threaded processor. In another implementation, the processor 510 is a multi-threaded processor. The processor 510 is capable of processing instructions stored in the memory 520 or on the storage device 530 to display graphical information for a user interface on the input/output device 540.

The memory 520 stores information within the controller 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the controller 500. In one implementation, the storage device 530 is a computer-readable medium. In various different implementations, the storage device 530 may be a floppy disk device, a hard disk device, an optical disk device, a tape device, flash memory, a solid state device (SSD), or a combination thereof.

The input/output device 540 provides input/output operations for the controller 500. In one implementation, the input/output device 540 includes a keyboard and/or pointing device. In another implementation, the input/output device 540 includes a display unit for displaying graphical user interfaces.

The features described can be implemented in digital electronic circuitry, or in computer hardware, firmware, software, or in combinations of them. The apparatus can be implemented in a computer program product tangibly embodied in an information carrier, for example, in a machine-readable storage device for execution by a programmable processor; and method steps can be performed by a programmable processor executing a program of instructions to perform functions of the described implementations by operating on input data and generating output. The described features can be implemented advantageously in one or more computer programs that are executable on a programmable system including at least one programmable processor coupled to receive data and instructions from, and to transmit data and instructions to, a data storage system, at least one input device, and at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example, both general and special purpose microprocessors, and the sole processor or one of multiple processors of any kind of computer. Generally, a processor will receive instructions and data from a read-only memory or a random access memory or both. The essential elements of a computer are a processor for executing instructions and one or more memories for storing instructions and data. Generally, a computer will also include, or be operatively coupled to communicate with, one or more mass storage devices for storing data files; such devices include magnetic disks, such as internal hard disks and removable disks; magneto-optical disks; and optical disks. Storage devices suitable for tangibly embodying computer program instructions and data include all forms of non-volatile memory, including by way of example semiconductor memory devices, such as EPROM, EEPROM, solid state drives (SSDs), and flash memory devices; magnetic disks such as internal hard disks and removable disks; magneto-optical disks; and CD-ROM and DVD-ROM disks. The processor and the memory can be supplemented by, or incorporated in, ASICs (application-specific integrated circuits).

To provide for interaction with a user, the features can be implemented on a computer having a display device such as a CRT (cathode ray tube) or LCD (liquid crystal display) or LED (light-emitting diode) monitor for displaying information to the user and a keyboard and a pointing device such as a mouse or a trackball by which the user can provide input to the computer. Additionally, such activities can be implemented via touchscreen flat-panel displays and other appropriate mechanisms.

The features can be implemented in a control system that includes a back-end component, such as a data server, or that includes a middleware component, such as an application server or an Internet server, or that includes a front-end component, such as a client computer having a graphical user interface or an Internet browser, or any combination of them. The components of the system can be connected by any form or medium of digital data communication such as a communication network. Examples of communication networks include a local area network ("LAN"), a wide area network ("WAN"), peer-to-peer networks (having ad-hoc or static members), grid computing infrastructures, and the Internet.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a y-tubular section sized to run into a wellbore formed from a terranean surface into a subterranean zone and configured to couple to a production tubing, the y-tubular section comprising a main tubular section, a primary tubular leg coupled to the main tubular section, and a secondary tubular leg coupled to the main tubular section and offset from the primary tubular leg, the secondary tubular leg sized to receive an electrical submersible pump (ESP); and a hydraulic flow control device positioned in the primary tubular leg and configured to selectively modulate toward an open position to fluidly couple the main tubular section to a portion of the primary tubular leg downhole of the flow control device and selectively modulate toward a closed position to fluidly decouple the secondary tubular leg from the portion of the primary tubular leg downhole of the flow control device based on a hydraulic signal from a hydraulic fluid system positioned at or near a terranean surface, the hydraulic fluid signal provided to the hydraulic flow control device from the hydraulic fluid system through a hydraulic fluid line that extends through the main tubular section and into the primary tubular leg to fluidly connect to the hydraulic flow control device.

2. The downhole tool of claim 1, wherein the hydraulic flow control device comprises a ball valve that comprises:

a housing comprising a housing bore; and a ball at least partially enclosed within the housing and comprising a ball bore alignable with the housing bore based on selective modulation of the flow control device toward the open position to fluidly couple the main tubular section to the portion of the primary tubular leg and misalignable with the housing bore based on selective modulation of the flow control device toward the closed position to fluidly decouple the secondary tubular leg from the portion of the primary tubular leg.

3. The downhole tool of claim 2, wherein the ball bore is sized to receive a logging tool therethrough.

4. The downhole tool of claim 2, wherein the ball valve comprises a hydraulic fluid chamber fluidly coupled to the hydraulic fluid line and comprising a volume sized to enclose a portion of hydraulic fluid from the hydraulic fluid system.

5. The downhole tool of claim 4, wherein the hydraulic signal comprises a change of pressure of the hydraulic fluid in the hydraulic fluid chamber based on operation of the hydraulic fluid system.

6. The downhole tool of claim 4, wherein the hydraulic fluid system comprises a hydraulic fluid pump and a hydraulic fluid controller.

7. The downhole tool of claim 1, wherein the hydraulic signal from the hydraulic fluid system positioned at or near the terranean surface is independent of a differential pressure across the hydraulic flow control device.

8. The downhole tool of claim 1, wherein the hydraulic flow control device is communicably coupled to the ESP.

9. A method, comprising:

operating a downhole tool coupled to a production tubing that is positioned in a wellbore formed from a terranean surface and extended into a subterranean formation, the downhole tool comprising:

a y-tubular section that comprises a main tubular section, a primary tubular leg coupled to the main tubular section, and a secondary tubular leg coupled to the main tubular section and offset from the primary tubular leg, and a hydraulic flow control device positioned in the primary tubular leg;

providing a hydraulic signal to the flow control device through a hydraulic flow line that extends from at or near the terranean surface, through the main tubular section and primary tubular leg, and to the hydraulic flow control device;

modulating the flow control device toward a closed position to fluidly decouple the secondary tubular leg from a portion of the primary tubular leg downhole of the hydraulic flow control device based on the hydraulic signal from a hydraulic fluid system positioned at or near the terranean surface;

subsequent to modulating the flow control device to the closed position, operating an electrical submersible pump (ESP) that is at least partially positioned in the secondary tubular leg to circulate a wellbore fluid through the secondary tubular leg, through the main tubular section, and into the production tubing;

modulating the flow control device toward an open position to fluidly couple the main tubular section to a portion of the primary tubular leg downhole of the flow control device based on another hydraulic signal from the hydraulic fluid system provided through the hydraulic flow line; and prior to or subsequent to modulating the flow control device to the open position, stopping operation of the ESP.

10. The method of claim 9, further comprising subsequent to modulating the flow control device to the open position, running a logging tool through the flow control device to log a portion of the wellbore downhole of the y-tubular section.

11. The method of claim 9, further comprising running the downhole tool into the wellbore.

12. The method of claim 9, wherein the flow control device comprises a ball valve that comprises a housing comprising a housing bore, and a ball at least partially enclosed within the housing and comprising a ball bore, the method further comprising:

aligning the ball bore with the housing bore based on modulating the flow control device toward the open position to fluidly couple the main tubular section to the portion of the primary tubular leg; and misaligning the ball bore with the housing bore based on modulating the flow control device toward a closed position to fluidly decouple the secondary tubular leg from the portion of the primary tubular leg.

13. The method of claim 12, wherein the ball valve comprises a hydraulic fluid chamber comprising a volume, the method comprising:

circulating a portion of hydraulic fluid from the hydraulic fluid system into the volume.

14. The method of claim 13, wherein the hydraulic signal comprises a change of pressure of the hydraulic fluid in the hydraulic fluid chamber based on operation of the hydraulic fluid system.

15. The method of claim 9, further comprising providing the hydraulic signal by operating a hydraulic fluid pump with a hydraulic fluid controller of the hydraulic fluid system.

16. The method of claim 15, wherein providing the hydraulic signal comprises providing the hydraulic signal independent of a differential pressure across the flow control device.

17. The method of claim 9, wherein the flow control device is communicably coupled to the ESP.

18. A downhole flow control system, comprising:

a production tubing positioned within a wellbore that extends from a terranean surface into a subterranean formation;

a y-tool that comprises:

a main tubular section coupled to the production tubing, a primary tubular leg coupled to the main tubular section, and a secondary tubular leg coupled to the main tubular section and offset from the primary tubular leg, and a hydraulic ball valve positioned in the primary tubular leg;

a hydraulic fluid line that extends from at or near the terranean surface, through the main tubular section and primary tubular leg, and to the hydraulic ball valve;

a downhole pump positioned in or downhole of the secondary tubular leg; and a control system positioned at or near the terranean surface and configured to perform operations comprising:

transmitting a hydraulic signal through the hydraulic fluid line to the hydraulic ball valve to modulate to a closed position;

when the hydraulic ball valve is in the closed position, operating the downhole pump to circulate a wellbore fluid through the secondary tubular leg and into the production tubing through the main tubular section;

transmitting another hydraulic signal to the hydraulic ball valve to modulate to an open position; and when the hydraulic ball valve is in the open position, stopping operation of the downhole pump.

19. The system of claim 18, wherein the control system comprises a hydraulic fluid pump and a hydraulic fluid pump controller, and the operation of transmitting the hydraulic signal to the hydraulic ball valve comprises operating, with the hydraulic fluid pump controller, the hydraulic fluid pump to circulate a hydraulic fluid at a particular pressure to the hydraulic ball valve.

20. The system of claim 19, wherein the hydraulic fluid pump controller is configured to perform operations comprising operating the hydraulic fluid pump to circulate the hydraulic fluid at another particular pressure to the hydraulic ball valve.

21. The system of claim 18, wherein the downhole pump comprises an electrical submersible pump (ESP).

* * * * *